US005416305A

United States Patent [19]

Tambellini

[11] Patent Number: 5,416,305

[45] Date of Patent: May 16, 1995

[54] MICROWAVE HEATING PACKAGE AND METHOD FOR ACHIEVING OVEN BAKED QUALITY FOR SANDWICHES

[76] Inventor: Daniel A. Tambellini, 2630 Sunnyfield Dr., Pittsburgh, Pa. 15241

[21] Appl. No.: 164,909

[22] Filed: Dec. 10, 1993

[51] Int. Cl.[6] ..... H05B 6/80

[52] U.S. Cl. ..... 219/730; 219/734; 426/107; 426/234; 426/241; 99/DIG. 14; 229/903

[58] Field of Search ..... 219/730, 759, 728, 734; 426/107, 113, 114, 109, 234, 241, 243; 99/DIG. 14; 229/903, 904

[56] References Cited

U.S. PATENT DOCUMENTS

| | | | |
|---|---|---|---|
| 4,051,266 | 9/1977 | Goltsos | 426/107 |
| 4,133,896 | 1/1979 | Standing et al. | 426/107 |
| 4,141,487 | 2/1979 | Faust et al. | 229/43 |
| 4,172,903 | 10/1979 | Daswick | 426/113 |
| 4,228,945 | 10/1980 | Wysocki | 229/30 |
| 4,328,254 | 5/1982 | Waldburger | 426/393 |
| 4,653,685 | 3/1987 | Leary et al. | 229/2.5 R |
| 4,676,857 | 6/1987 | Scharr et al. | 219/730 |
| 4,735,513 | 4/1988 | Watkins et al. | 383/116 |
| 4,866,232 | 9/1989 | Stone | 219/730 |
| 4,878,765 | 11/1989 | Watkins et al. | 383/116 |
| 4,935,252 | 6/1990 | Huang et al. | 426/107 |
| 4,943,439 | 7/1990 | Andreas et al. | 426/107 |
| 4,948,932 | 8/1990 | Clough | 219/730 |
| 4,994,638 | 2/1991 | Iorns et al. | 219/10.55 E |
| 5,034,234 | 7/1991 | Andreas et al. | 426/107 |
| 5,045,330 | 9/1991 | Pawlowski | 219/730 |
| 5,049,710 | 9/1991 | Prosise et al. | 219/10.55 E |
| 5,084,601 | 1/1992 | Andreas et al. | 219/10.55 E |
| 5,213,256 | 5/1993 | Cyr | 229/120.32 |

*Primary Examiner*—Philip H. Leung
*Attorney, Agent, or Firm*—Carothers & Carothers

[57] ABSTRACT

A package for microwave heating of a sandwich product which normally contains a bread component and non bread components which are either inserted into the bread or deposited on the bread. The non bread components, such as meats, chicken, fish, cheese, vegetables, sauces and the like are placed into a separate container and this non bread component container and the naked bread component are simultaneously contained within a microwave heating package. Microwave susceptor material surrounds at least portions of the bread component for crisping the bread to give it a good baked quality. The non bread component container may first be removed from the package so that the bread component and non bread components may be microwaved separately.

9 Claims, 2 Drawing Sheets

MICROWAVE HEATING PACKAGE AND METHOD FOR ACHIEVING OVEN BAKED QUALITY FOR SANDWICHES

FIELD OF INVENTION

The present invention relates generally to packaging for microwave cooking of sandwiches.

BACKGROUND OF THE INVENTION

In recent years, many developments have been made in microwave packaging to help improve the quality of sandwiches for microwave heating. Many materials exist that convert microwave energy into heat thus providing crisping, browning or toasting of foods such as bread. Some of the many materials developed for providing crisping of the surface of cooked food are those disclosed in U.S. Patent Nos. 4,518,651; 4,267,420; 4,434,197; 4,612,431; 4,735,513. The material is generally referred to as microwave susceptor material.

In the convenience oriented world in which we live, retailers such as supermarket grocers would find it highly desirable to make available to the consumer a variety of sandwiches that would microwave as well as an oven baked sandwich made fresh at a pizzeria or sub shop. With the tremendous proliferation of pizzerias and sub shops, as well as other fast food units, there is hard felt need for the aforementioned retailers to reverse the erosion of their share of the consumer dollar expended on food. More importantly, most consumers long for products that quickly microwave with quality that approaches the quality achieved when heating with a conventional oven.

As prior art reveals, deficiencies have prevented any microwaved sandwich from coming close to the quality of an oven baked pizzeria or sub shop sandwich. Attempts to use materials that facilitate crisping i.e. suceptors and/or the use of specially formulated breads, have resulted in inferior product.

One major shortcoming is the amount of time needed to heat the sandwich throughout causing the bread to be exposed to too much microwave energy even when susceptor is used. After heating is complete, the product is perceived as having bread too tough, dry and hard in many spots. In turn, if the product is microwaved less time in order to produce soft bread with a crisp surface, this often results in cold spots in other areas of the sandwiches.

Additionally, the juices and/or water separation from the meats, chicken, fish, sauces etc., can make the bread in contact soggy due to this moisture separation that can occur during production, the storage period and especially during the microwaving period. To help alleviate this separation, ingredients such as binders, starches and zanthum gums are often utilized but these detract from the quality and purity when compared to sandwiches made without these ingredients at a pizzeria or sub shop.

Another shortcoming is the time needed to microwave the conventionally packaged sandwich of prior art. It would be desirable to most consumers to be able to dramatically decrease the microwaving time.

OBJECTS AND ADVANTAGES OF THE PRESENT INVENTION

The microwave heating package of the present invention is for microwave heating of a bread and non bread combination product, such as a sandwich which includes a bread component and a non bread component. Such non bread components include, for example, meats, chicken, fish, cheese, vegetables and/or sauces. These non bread components are conventionally deposited on or inserted into the bread component.

The microwave heating package of the present invention consists generally of a first container which contains the non bread components and a second container which simultaneously contains the first container and the bread component independently, such that there is no insertion or deposit of the non bread component on or in the bread. Microwave susceptor material surrounds at least portions of the bread component and may, as desired, also surround portions of the non bread component container.

It is preferable that the susceptor material surround the bread component in a snug glove like fashion in order to give the best results.

The outer or second container is adapted such that it may be easily opened and the non bread container removed so that the bread component and the non bread components may be microwaved separately for different time periods, if desired.

The microwave package of the present invention is for microwave heating sandwiches, including subs. Some examples of these sandwiches are: Meatball, Sausage, Cheese Steak, Italian, Chicken, Fish, etc. The package enables the sandwich to microwave with quality equal to that of oven baked. The bread, which would include rolls, results in a toasted surface with the inside of the bread remaining soft, tender and never soggy, tough, dry or hard. The meats, fish, chicken, sauces, cheeses etc., never have cold spots or dry edges and do not make the bread soggy during the heating process.

A major factor in accomplishing the above is to deviate from Webster's definition of a sandwich which states: Two or more slices of bread with meats, chicken, vegetables, etc., between them.

This invention separates the bread as one component and the other ingredients as a second or plurality of components, herein referred as the non bread component. When microwaving, the package facilitates the choice to microwave the bread component less time than the non bread component. The bread is preferably wrapped with susceptor material in a snug contacting relation. It is not intended to limit the invention to any particular susceptor material, the technique in surrounding the bread or the configuration of the bread. Accordingly, for example, the bread could be placed in a snug fitting carton with layers of susceptor material lining a plurality of carton walls.

Additionally, as opposed to the conventional sandwich packaging, the concern about water and/or juice separation from the meats, chicken, fish, sauces, cheeses, etc., onto the bread is eliminated. This can occur during production, during the storage period and especially during the microwaving heating period. This must be offset to avoid wet or soggy bread.

As the prior art reveals, attempts have been made to alleviate this problem by either using dryer ingredients or utilize starches, binders, xantham gum or the like. An ingredient statement without these would appeal to today's additive conscious consumer.

This invention enables the consumer to simply slightly shake or stir the non bread component before pouring or dumping it over the bread, thus helping to place moisture separation back in suspension. Therefore, the invention facilitates the use of ingredients that are inherently juicy or those with a natural high water content such as vegetables, without having to incorporate the additives stated above.

Additionally, before pouring the non bread component on the bread, the consumer has the option to skim or drain off the excess moisture which could include animal fat or unwanted oil depending on the ingredients used, as today it is highly desirable for many people to reduce their fat intake.

Additionally, as opposed to the conventional method for packaging a sandwich, the invention dramatically reduces the time needed to microwave. For example, a meatball sandwich of prior art on the market weighing 6.6 ounces directs to microwave frozen for 6 minutes then let stand 1½ minutes before serving. On the other hand, a meatball sandwich weighing 9.75 ounces under the invention packaging microwaves frozen in 4 minutes 30 seconds without any standing period before serving. In summation, using the same microwave for both, a conventionally packaged sandwich (32% smaller) takes 66% more time to heat before serving. Or stated differently, the invention packaged sandwich (47% larger) takes 40% less time to heat before serving.

Additionally, the consumer can regulate, if he or she desires, the crispness of the bread without concern for cold spots in the meats, fish, chicken, sauces, etc., or conversely, burning areas of the meats, fish, chicken, sauces, etc.

Also, a line of sandwiches can be marketed for the microwave that meet vernacular stated "over stuffed" status to compete with the fast food chains double or triple burgers. The meats, chicken, fish, sauces, etc., can be microwaved as long as it takes to thoroughly heat without concern about the bread heating too long.

Readers will find further objects and advantages of the invention after reading the ensuing description and the accompanying drawings.

BRIEF DESCRIPTION OF THE DRAWINGS

The invention has generally been described, and will now be referred to more specifically, in reference to the accompanying drawings illustrating preferred embodiments and in which.

DETAILED DESCRIPTION OF THE PREFERRED EMBODIMENTS

Figure 1:
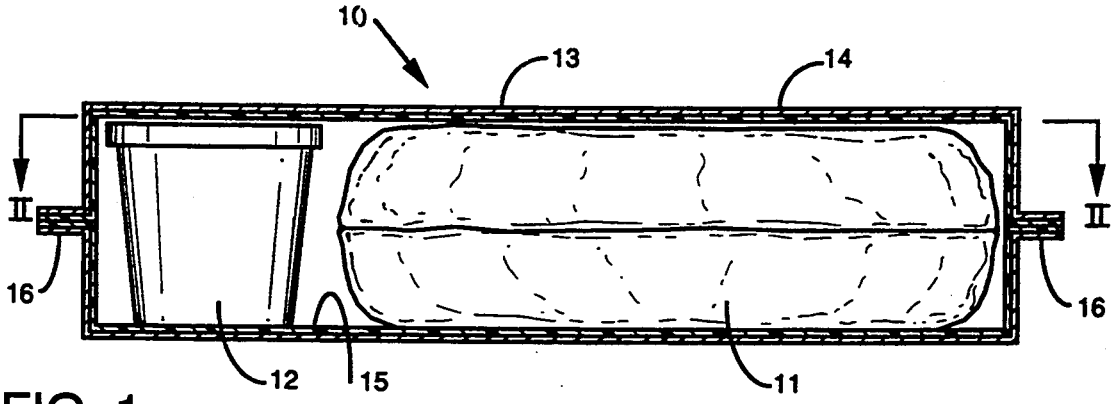
FIG. 1 is a view in side elevation illustrating one embodiment of the microwave heating package of the present invention shown in vertical cross section as seen along section line I—I of FIG. 2 to permit viewing of the bread component and non bread component container within the interior.
Figure 2:
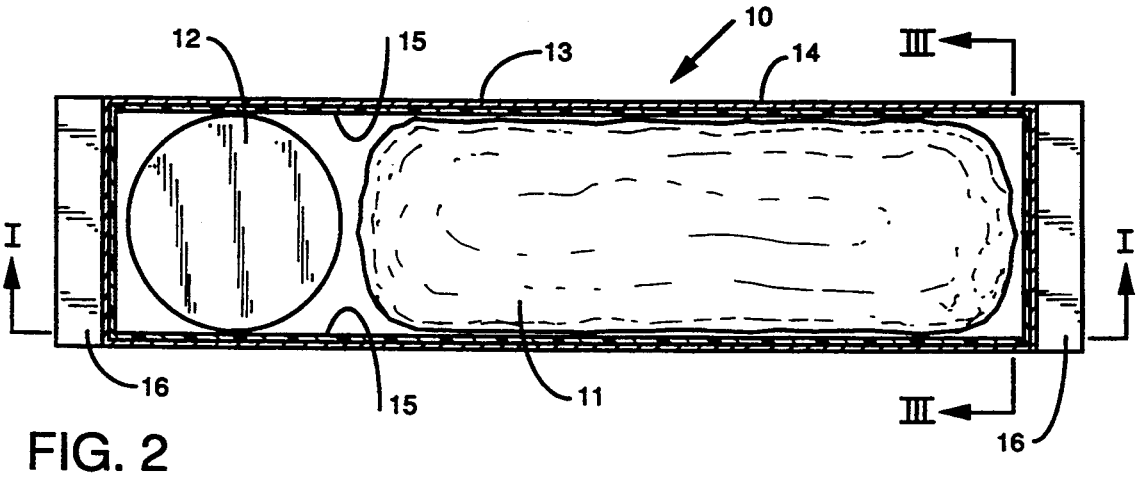
FIG. 2 is a top view of the microwave package shown in FIG. 1 as seen in horizontal cross section taken along section line II—II in FIG. 1.
Figure 3:
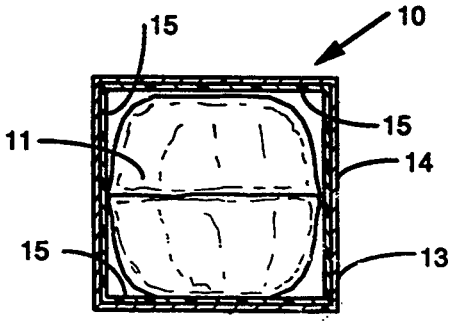
FIG. 3 is an end view in vertical cross section as seen along section line III—III of FIG. 2 of the microwave heating package shown in FIGS. 1 and 2.

Referring to FIGS. 1, 2 and 3, a first embodiment of the microwave heating package 10 of the present invention is illustrated. The package 10 contains a bread component 11 and a non bread component sealed or contained within first container 12.

The bread component 11 shown is an elongated bun which is sliced down the middle for opening to insert sandwich components to ultimately make a sandwich which is commonly referred to as either a hoagie or a submarine or sub sandwich. However, the bread component could be of any shape or form, such as a hamburger bun or Kaiser roll. The non bread components contained within container 12 may include such ingredients as meats, chicken, fish, cheese, vegetables, sauces, etc. Container 12 is preferably constructed of a disposable paper or plastic product which can withstand heat when the non bread components contained therein are surrounded by susceptor material as in this embodiment. If other material were used for container 12 that could not withstand heat created by susceptor, then container 12 would be removed from package 10 and set to the side of the remaining package 10 in the microwave.

Accordingly, the non bread components are completely separated from the bread component 11 so that an option is facilitated to remove container 12 from the package 10 and the non bread components may be microwaved separately, or side by side simultaneously, if desired, in container 12 from the bread component 11, which remains in microwave heating package 10.

The second container 13 of package 10 consists of an outer layer 14 constructed of a suitable paper product, such as a paper bag or a paper board or cardboard box, and an integral inner microwave susceptor material layer 15. In this embodiment, susceptor layer 15 is integrally bonded or laminated to the outer paper container 14 and completely surrounds the entire interior of package 10. Thus in this embodiment, the microwave susceptor material 15 encloses not only the bread component 11, but also the non bread component container 12.

The microwave heating package 10 is provided with sealed end opening or lips 16 which may be torn apart or opened to remove container 12, if desired, for separate microwave heating treatment, and to also permit ventilation of the interior of package 10 when microwaving the bread component 11 therein.

As illustrated, it is also preferable that the susceptor material or layer 15 fit around the bread component 11 snugly in glove like fashion.

While in the preferable embodiment the non bread ingredients within container 12 are completely contained within container 12 and none are inserted on or within the bread product 11 during the process of microwave heating, nevertheless, it may be desirable to insert selected of the non bread components within container 12 into or on the bread 11 prior to packaging and microwaving. Such selected non bread components would be those components only which would not deteriorate the bread product or otherwise make it soggy or interfere with its texture or quality.

Figure 4:
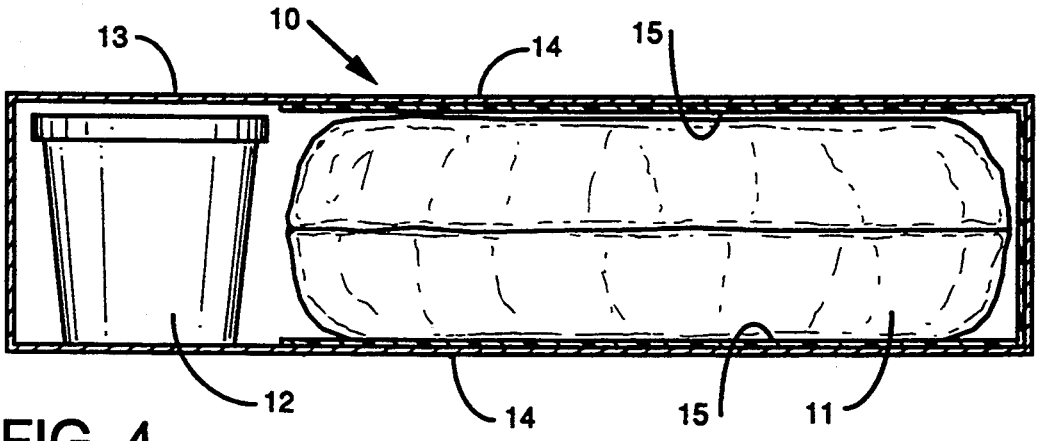
FIG. 4 is a view in side elevation and vertical cross section illustrating another embodiment of the microwave heating package of the present invention.

Turning next to FIG. 4, another embodiment of the microwave package 10 is illustrated wherein the susceptor lining 15 only surrounds the bread component 11 and does not extend within the package 10 beyond the bread component. Accordingly, the susceptor material does not cover any portions of the non bread component container 12.

Figure 5:
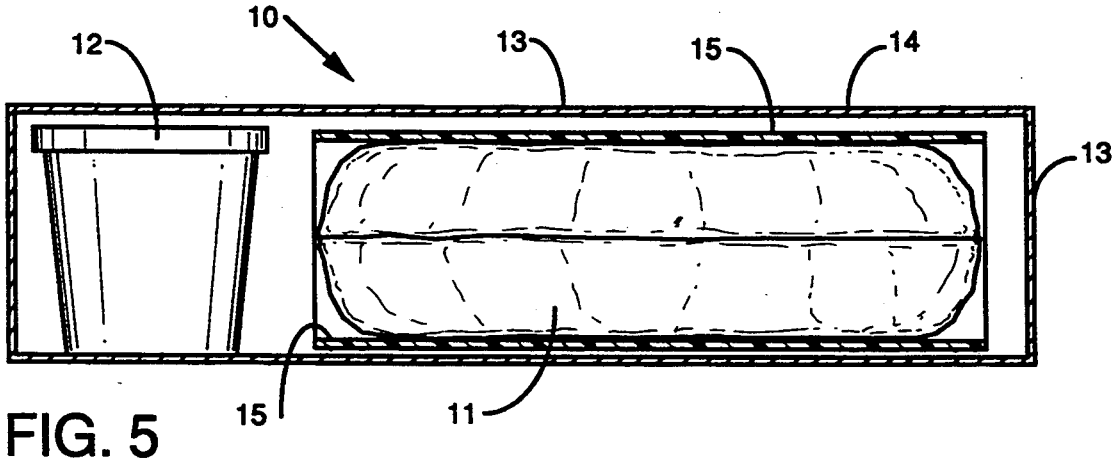
FIG. 5 is a view in side elevation and vertical cross section illustrating yet another embodiment of the microwave package of the present invention.

Referring next to FIG. 5, the microwave package 10 there illustrated is substantially the same as the embodiment illustrated in FIG. 4, except that the susceptor lining 15 is not laminated to or bonded with the outer packaged layer 14. In this embodiment, the susceptor material 15 is provided in the form of a separate sheet or flexible wrap material whereby the bread component 11 is independently wrapped in a tight glove like fashion around the bread product 11 before it is inserted into the container or into the package 10.

I claim:

1. A microwave heating package for microwave heating of a food combination product, including a bread component and at least one non bread component selected from the group consisting of meats, chicken, fish, cheese, vegetables and sauces, for deposit on or insertion into the bread component, said package comprised of an independent first container containing at least one of said non bread components and a second container simultaneously containing both said first container and said bread component independently for removal of said first container from said second container for microwave cooking independent of said bread component, and microwave susceptor material at least surrounding portions of said bread component.

2. The microwave heating package of claim 1 wherein the susceptor material also encloses at least portions of said first container.

3. The microwave heating package of claim 1 wherein the susceptor material only encloses at least portions of said bread component and does not enclose portions of said first container.

4. The microwave heating package of claim 1 wherein the susceptor material is an integral portion of said second container.

5. The microwave heating package of claim 1 wherein the susceptor material is segregated from said second container and is independently wrapped around said bread component.

6. The microwave heating package of claim 1 wherein said second container is constructed of a paper product and is sized to surround said bread component in snug glove like fashion.

7. The microwave heating package of claim 6 wherein the susceptor material only encloses at least portions of said bread component and does not enclose portions of said first container.

8. The microwave heating package of claim 1 wherein said susceptor material surrounds at least portions of said bread component snugly in glove like fashion.

9. The microwave heating package of claim 1 wherein said second container is adapted for opening and reclosing, at least partially, so that said first container can be removed thereby permitting said bread component and said non bread component to be separately microwaved.

* * * * *